US005192438A

United States Patent [19]

Frejborg

[11] Patent Number: 5,192,438

[45] Date of Patent: * Mar. 9, 1993

[54] ROTATING ELEMENT FOR SCREENING APPARATUS WITH A CONTOUR SURFACE PRODUCED BY A PLURALITY OF PROTRUSIONS IN THE DIRECTION OF THE AXIAL LENGTH OF THE ROTOR

[75] Inventor: Frey Frejborg, Glen Falls, N.Y.

[73] Assignee: A.Ahlstrom Corporation, Noormarkku, Finland

[ * ] Notice: The portion of the term of this patent subsequent to Aug. 21, 2007 has been disclaimed.

[21] Appl. No.: 567,258

[22] Filed: Aug. 14, 1990

Related U.S. Application Data

[63] Continuation-in-part of Ser. No. 252,810, Oct. 3, 1988, Pat. No. 4,950,402, which is a continuation-in-part of Ser. No. 41,241, Apr. 22, 1987, Pat. No. 4,776,957, said Ser. No. 61,594, is a continuation-in-part of Ser. No. 738,743, May 29, 1985, Pat. No. 4,676,903, which is a continuation-in-part of Ser. No. 472,742, Mar. 7, 1983, Pat. No. 4,529,520.

[51] Int. Cl.[5] ..... B01D 29/62; B07B 1/20

[52] U.S. Cl. ..... 210/413; 209/273

[58] Field of Search ..... 162/55, 380; 209/273, 209/300, 305, 306, 379, 397; 210/413, 415, 498

[56] References Cited

U.S. PATENT DOCUMENTS 4,586,172 6/1971 Young ..... 210/415

4,950,402 8/1990 Frejborg ..... 209/273

*Primary Examiner*—Ivars Cintins

*Attorney, Agent, or Firm*—Buchnam and Archer

[57] ABSTRACT

An apparatus for screening pulp comprises a vessel, a cylindrical screen within the vessel, a rotor moving in the vicinity of the screen at a predetermined speed, an inlet for the unscreened pulp, an outlet for the screened pulp in the vessel. The rotor is non-cylindrical, for instance, elliptical, triangular, and in general, is multi-cam. The rotor has a contour surface which is achieved by attaching bars of the contoured shape to the surface of the rotor, for instance by welding. According to one embodiment, the contour surface of the rotor is discontinuous. The bars form a plurality of spaced protrusions instead of a single protrusion along the entire axial length of the rotor.

29 Claims, 17 Drawing Sheets

ROTATING ELEMENT FOR SCREENING APPARATUS WITH A CONTOUR SURFACE PRODUCED BY A PLURALITY OF PROTRUSIONS IN THE DIRECTION OF THE AXIAL LENGTH OF THE ROTOR

The present application is a Continuation-in-Part of U.S. Ser. No. 252,810 filed Oct. 3, 1988, now U.S. Pat No. 4,950,402, which is a Continuation-in-Part of U.S. Ser. No. 041,241 filed Apr. 22, 1987 and U.S. Ser. No. 061,594 filed June 11, 1987. U.S. Ser. Nos. 041,241 and 061,594 are Continuations-in-Part of U.S. Ser. No. 738,743 filed May 29, 1985 which issued as U.S. Pat. No. 4,676,903. U.S. Ser. No. 738,743 is a Continuation-in-Part of U.S. Ser. No. 472,742 filed Mar. 7, 1983 which issued as U.S. Pat. No. 4,529,520 on July 15, 1985. U.S. Ser. No. Pat. No. 041,241 and U.S. Ser. No. 061,594 have issued as U.S. Pat. No. 4,776,957 and U.S. Pat. No. 4,880,540 respectively. The subject matter of U.S. Ser. Nos. 472,742, 738,743, 041,241, 061,594 and 252,810 is incorporated herein by reference.

The present invention relates to a screening apparatus which is intended primarily for screening and purification of pulp and more specifically paper pulp. This screening apparatus comprises a vessel, a cylindrical screen in the interior of the vessel, a non-cylindrical rotor which moves in the vicinity of the screen surface, an inlet for the pulp to be screened, an outlet for the reject and another outlet for the screened pulp, which is called the accept.

In U.S. Pat. No. 4,529,520, the screening apparatus has an inlet on one side for introducing the unscreened pulp, and an outlet in the opposite side for removing the reject portion. Means are provided for moving the unscreened pulp along one first direction of flow. The screen plate has grooves in the side of the inlet recessed in the screen surface, the first direction of flow being essentially transverse to the grooves. The grooves are formed of an upstream side plane, a downstream side plane and a bottom plane. The bottom plane is essentially parallel to the envelope surface of the screen plate. The grooves have apertures, holes or slots, in the bottom plane. The upstream side plane of the grooves, as seen standing from the bottom of the grooves, is substantially perpendicular to the envelope surface and the downstream side plane of the grooves forms an angle of 60°-5° against the envelope surface. According to one embodiment, the angle between the downstream side plane of the grooves and the envelope surface of the screen plate is about 30°.

U.S. Pat. No. 4,676,903 defines a rotor intended to increase the intensity of the pulses generated near the openings, either holes or slots within the screen plate, for the purpose of creating the negative pulses necessary to backwash the screen and to prevent plugging. The screen has an inlet side and an outlet side and the rotor is located on the inlet side of the screen. The rotor described in this patent has a contoured surface, with grooves formed of a first plane parallel to the envelope surface, an inclined plane, an upper plane and a side plane, the side plane is essentially perpendicular to the first plane, the inclined plane forming an angle between 30°-60° with the first plane, the upper plane being parallel to said first plane. Also the screen cylinder has a contoured surface with grooves.

In the paper-making process, pulp is produced by cooking wood which separates the wood into fibers.

Due to the different properties of the wood even from the same tree, some of the fibers do not separate and are dispersed as fiber bundles usually called debris, shives or slivers which form the reject. There are also other impurities, such as bark, which must be removed. The screen must separate the undesired impurities and debris called the rejects from the accept portion. In order to avoid substantial losses of fibers which could be carried over together with the debris in the reject portion, it is necessary to remove the impurities efficiently and selectively.

It should be stressed that different applications have different requirements. In some applications, it is necessary to achieve a high content of long fibers, especially secondary fibers, in the accept because the long fibers give strength to the final product, for instance paper. In other applications, on the other hand, the contrary is true. For instance, in virgin or pulp mill fibers, it is desirable to concentrate the long fibers in the reject for reject refining.

A great deal of work has been carried out in connection with screen plates and rotors and it has been recognized that means to create pulsations with the rotor will increase the efficiency of the screening apparatus. U.S. Pat. No. 3,363,759 and U.S. Pat. No. 4,318,805 describe drum rotors with a bumped surface which provides pulsations. In U.S. Pat. No. 4,318,803 the bumps take the form of pins projecting from the rotor with enlarged heads, the heads providing the pulses while the pins offer little resistance to flow.

U.S. Pat. No. 4,447,320 and U.S. Pat. No. 4,200,537 describe rotors which carry blades or vanes moving in the vicinity of the screen which produce a positive pulse. Other patents describe other types of rotors, for instance, U.S. Pat. No. 3,726,401 uses a rotor with bumps or protuberances which produce about equal positive and negative pulses. According to this patent, any form of bumps may be used provided it produces the desired pulses, the bumps and the depressions between them creating positive screening and negative screen cleaning pressure pulses.

U.S. Pat. No. 3,400,820 describes a rotary member made up of a plurality of separate segments joined together and forming a selective undulating pattern which produces about equal positive and negative pulses.

One object of the present invention is to provide a rotor which provides high intensity axial shear stresses in addition to high positive pulses and which still maintains high intensity of the pulses, both positive and negative pulses generated near the openings, either holes or slots, within the screen plate, for the purpose of creating the positive pulses to help force the longer fibers through the openings within the screen and the negative pulses which are necessary to backwash the screen and to prevent plugging.

Still another object is to provide a rotor which may be used in an apparatus in which the screen has an inlet side and outlet side and the rotor is located on the inlet side of the screen, but the contour surface of the screen may be the outer or the inner surface of the screen cylinder and the flow of the accept may be either inwardly or outwardly.

Another object is to provide a rotor which produces sharp and steep pulses, thus resulting in high intensity.

Another object is to provide a rotor which permits to operate with smaller apertures in the screen cylinder thus improving the screening efficiency.

Still another object is to provide a rotor which may be used in conjunction with the screen plate described and claimed in U.S. Pat. No. 4,529,520, but is not limited to the screen plate of this patent.

Specifically, an object of the present invention is to provide a rotor which generates a combination of positive and negative pulses, both high frequency and low magnitude pulses and low frequency and high magnitude pulses and which also provides high intensity axial shear stresses.

It has now been found that both the specific contour of the rotor surface and the non-cylindrical shape of the rotor as described hereinbelow are particularly advantageous in producing a combination of higher intensity pulses and sufficient negative pulses so that plugging of the screen is minimized, due both to the contour shape of the surface of the rotor and the fact that the rotor is non-cylindrical or cam-shaped. According to one embodiment, the contour surface of the rotor is discontinuous.

The non-cylindrical shape of the rotor combined with the contoured surface of the rotor surprisingly permits to achieve high frequency and low amplitude pulses and also low frequency and high amplitude pulses. This combination also permits to achieve such a turbulence that the pulp remains in a fluidized state, while passing through the smaller apertures of the screen.

U.S. Ser. No. 252,810 describes a rotor with a non-cylindrical shape having a contour surface produced by grooves or bars on the rotor surface. It has now been found that substantial advantages are achieved if the bars form a plurality of spaced protrusions along the entire axial length of the rotor, instead of a single bar along the entire axial length of the rotor.

The present invention will be illustrated in more detail by reference to the accompanying drawings of which:

FIGS. 1 and 1*a* illustrate the contour surface of one embodiment of the rotor in accordance with the present invention which produces pumping and high frequency:

FIGS. 2 and 2*a* illustrate another embodiment of the rotor according to the present invention;

FIGS. 3 and 3*a* illustrate still another embodiment of the rotor according to the present invention:

FIGS. 4 and 4*a* illustrate still another embodiment according to the present invention:

FIGS. 5*a*, 5*b* and 5*c* show the contoured surface of the rotor but with bars;

FIGS. 10 A, B and C illustrate different shapes of protrusions.

Figure 11:
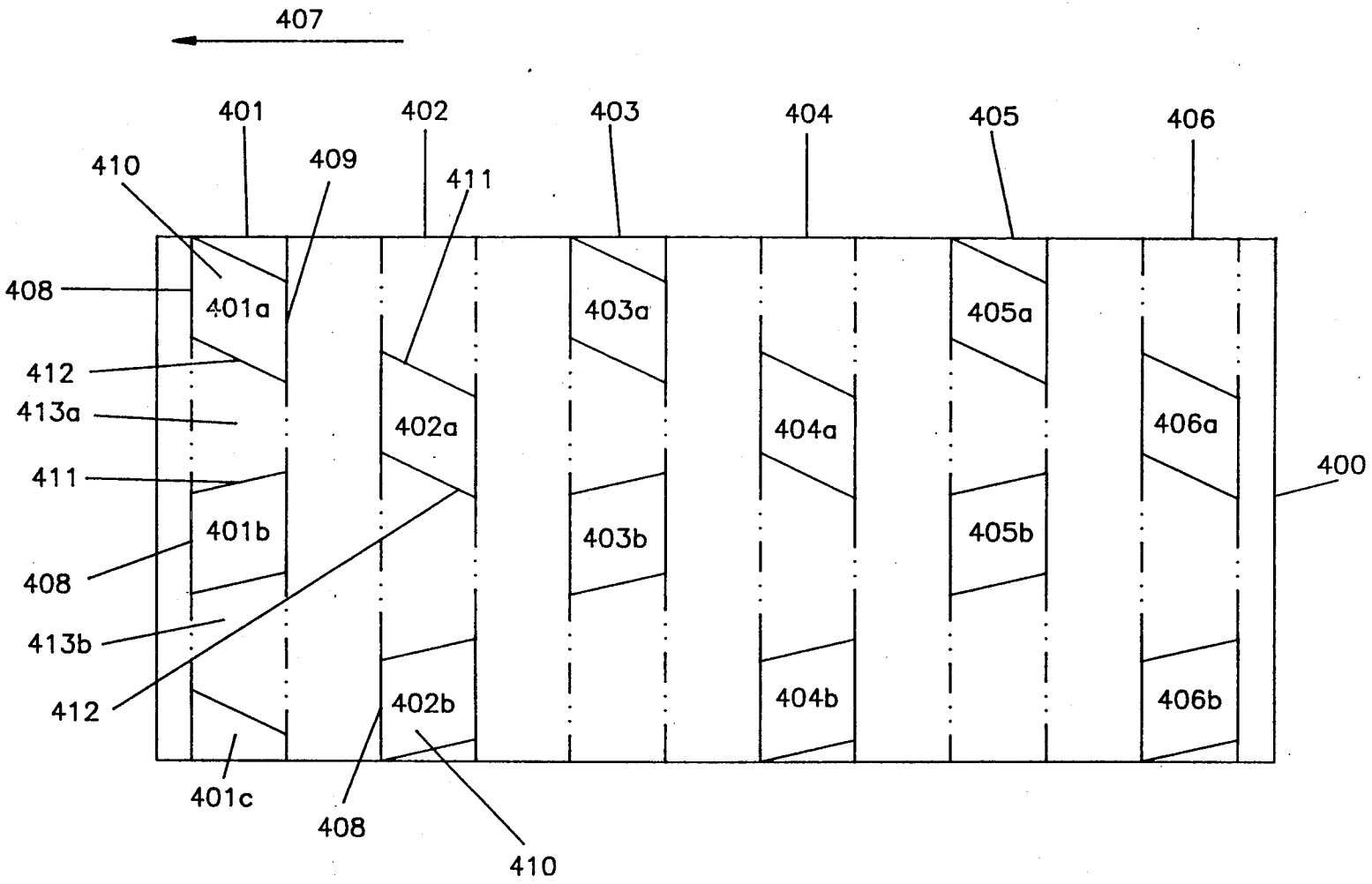

FIG. 11 illustrates another embodiment of the rotor with a plurality of spaced protrusions, and with discontinuous contour surface.

Figure 19:
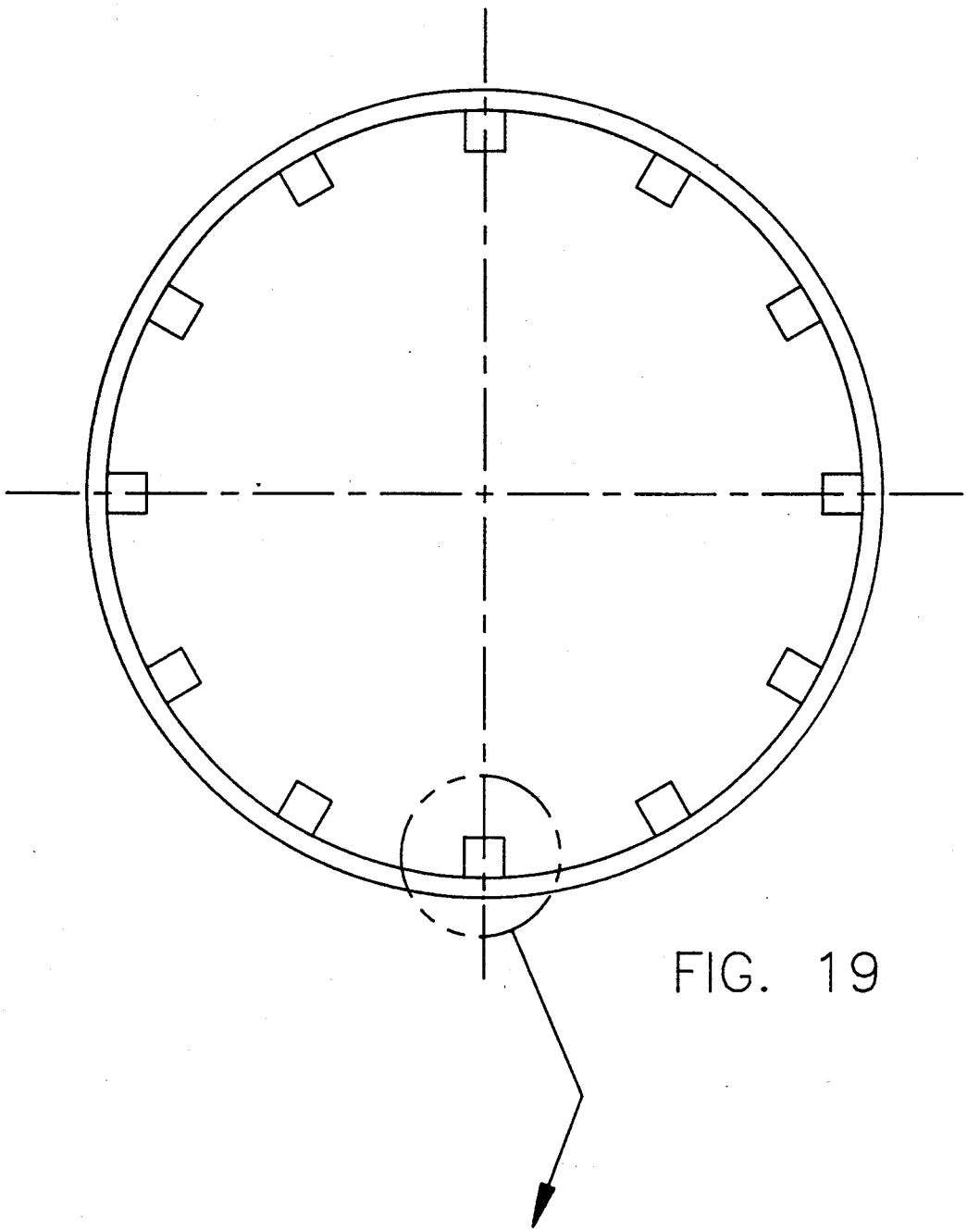
Figure 19A:
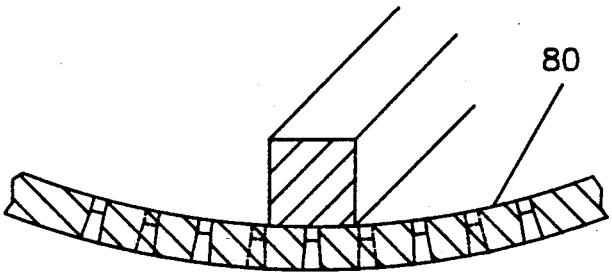

FIGS. 12-18 illustrate different embodiments of the contoured surface of the screen plate which may be used with the rotor according to the present invention:

FIG. 19 and 19*a* show the contoured surface of the screen plate which has bars instead of grooves.

By reference to FIGS. 1, 1*a*, 2, 2*a*, 3, 3*a*, 4, 4*a* numeral 10 designates the first bottom plane and numeral 20 designates the inclined plane. Numeral 30 designates the upper plane and numeral 40 designates the side plane perpendicular to the first plane. The leading contoured surface has a first plane 10 parallel to the envelope surface. It then intersects side plane 40 forming essentially a right angle which produces the high intensity positive pulses which help force the long type fibers and liquid through the screen. The side plane continues until it intersects the upper plane 30 again forming essentially another right angle. Upper plane 30 continues parallel to the envelope surface, then slopes forming an inclined plane 20 until it reaches the bottom plane.

Figure 1:
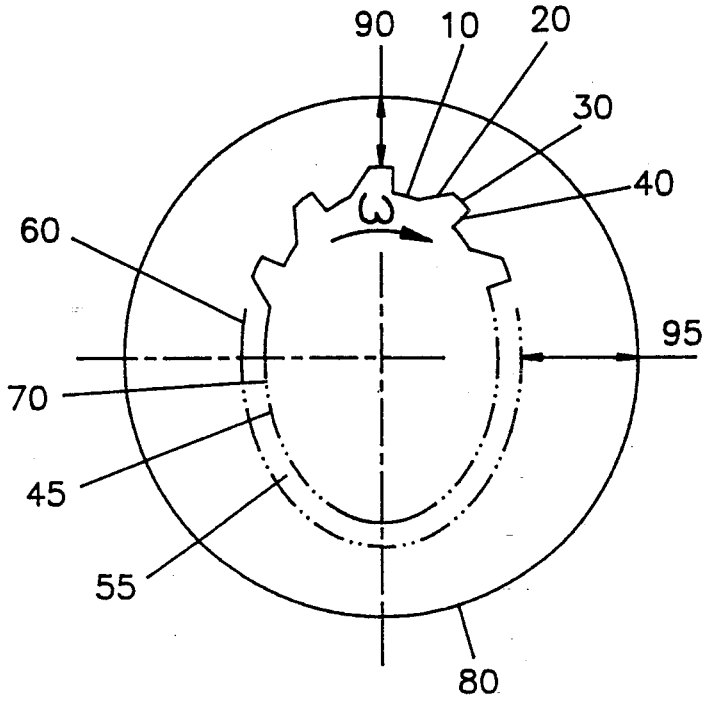
Figure 1A:
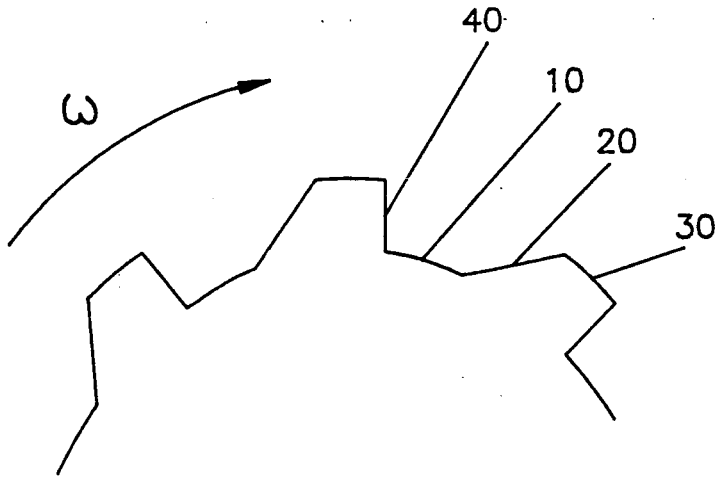

FIG. 1 illustrates a rotor with an elliptical shape. As shown in the figure, the rotor has a contour surface with the leading surface side plane 40 which produces high intensity positive pulses. A negative pulse is produced as the fluid flows over the upper plane surface 30 and the diverging inclined plane 20. Therefore, the pulses produced by the contour surfaces are positive pulses followed by a negative pulse. The frequency of these pulses for a typical rotor may be in the range of 200 to 600 Hz.

As shown in FIG. 1, the upper plane 30 is essentially parallel to the first plane 10, both forming when connected an elliptical shape paths 60 and 70 respectively. The clearance between rotor 45 and the concentric screen cylinder 80 will vary from a minimum clearance 90 along the major axis of the ellipse to the maximum clearance point 95 along the minor axis. Therefore, as the rotor moves, stock within the screening zone 55 is pumped from the maximum clearance point 95 to the minimum clearance 90, and this pumping action forces the stock through the screen cylinder while reducing the overall pressure drop across the screen itself.

Figure 2:
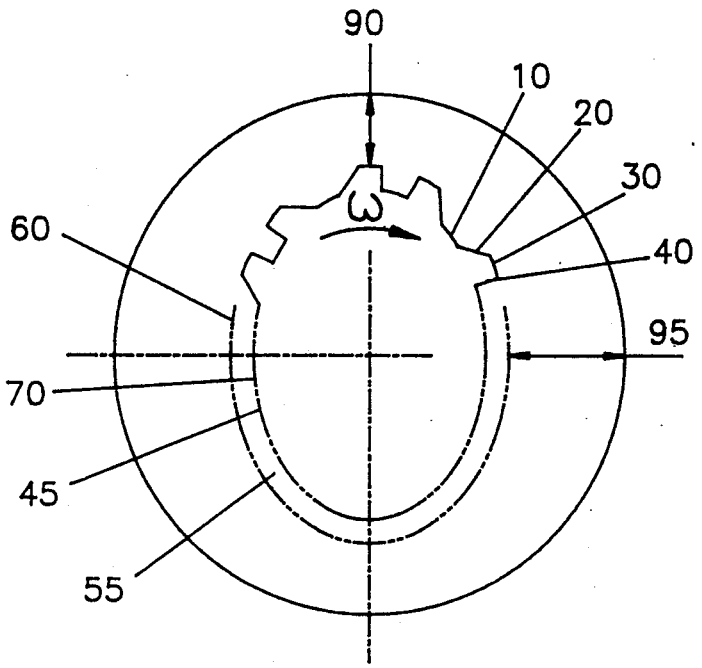
Figure 2A:
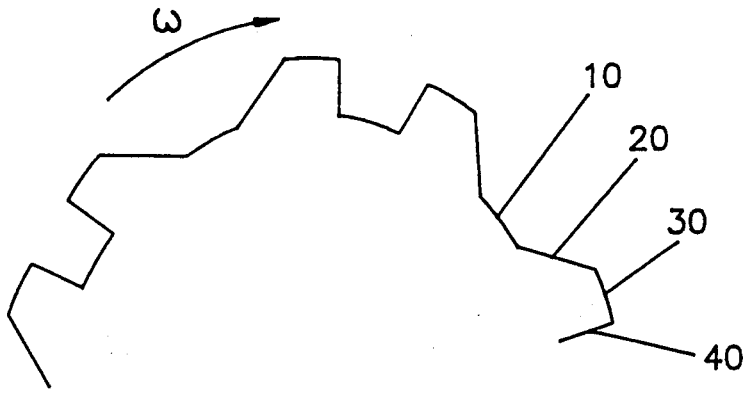

FIGS. 2 and 2*a* show another contour surface configuration which may have some advantages in higher efficient screening applications. As shown the leading surface of the contour surface is alternating between side plane 40 and the inclined plane 20. With side plane 40 as the leading surface, a high intensity positive pulse is produced followed by a lower intensity negative pulse due to the inclined surface. A very high intensity positive pulse would tend to force both the fibers and contaminants through the apertures within the screen. With the inclined plane 20 as the leading surface, a lower intensity and lower magnitude positive pulse is produced followed by a higher intensity negative pulse due to the sharp diverging change in direction of the stock flowing over the side plane surface 40. This high intensity negative pulse helps the backflushing of the apertures within the screen, keeping it from plugging. The lower intensity positive pulse also forces less contamination through the screen thus achieving higher screening efficiencies. Therefore, this alternating contour surface rotor gives both good capacity and efficiency.

Figure 3:
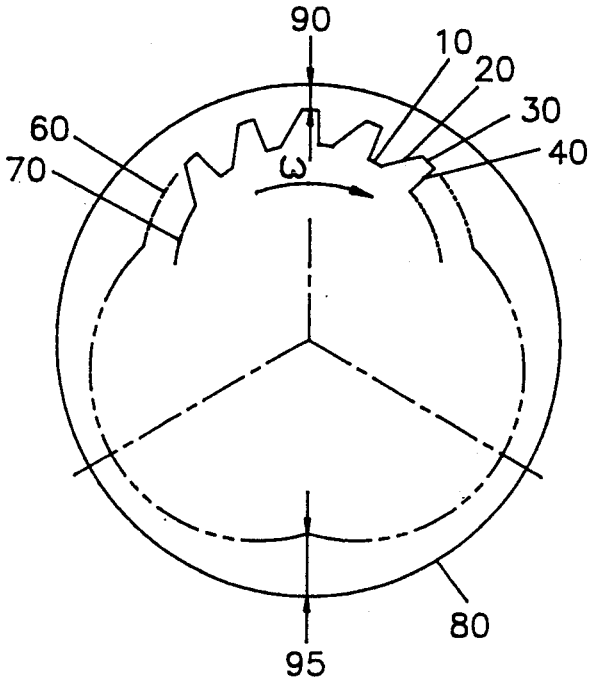
Figure 3A:
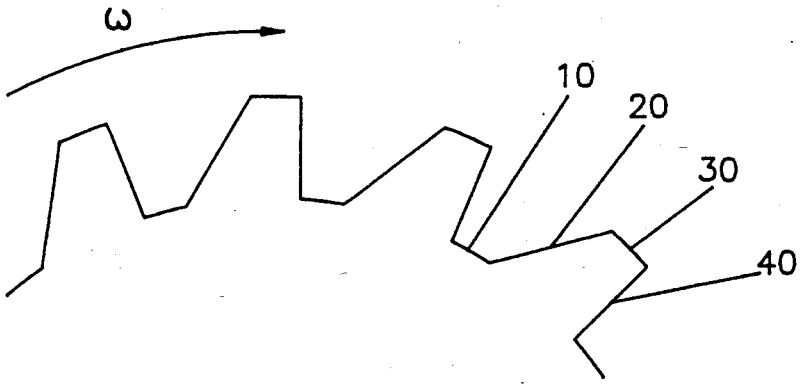

FIG. 3 shows a trilobed rotor with a contour surface. The advantage of this rotor over an elliptical rotor is that the positive and negative pulses are 120 degrees apart instead of 180 degrees with an elliptical rotor. The reason is that the pulses 180 degrees apart might cause the screen cylinder to assume an egg shape and put a very high load on the screen cylinder which might cause it to fail. The trilobed rotor also gives more pumping action than the elliptical rotor, due to the increase of pulse frequency.

With reference to the rotors illustrated in FIGS. 1, 2 and 2a, the clearance varies between ⅛" and 1½".

Figure 4:
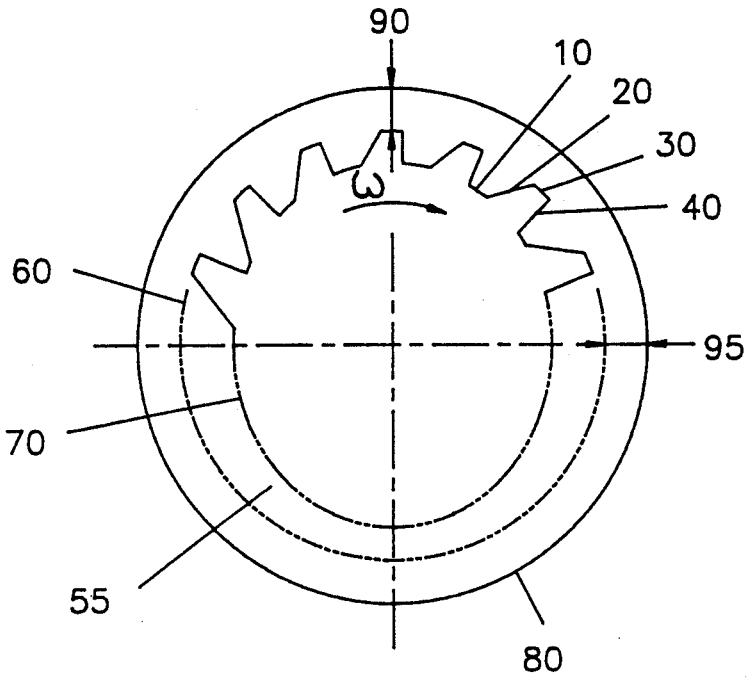
Figure 4A:
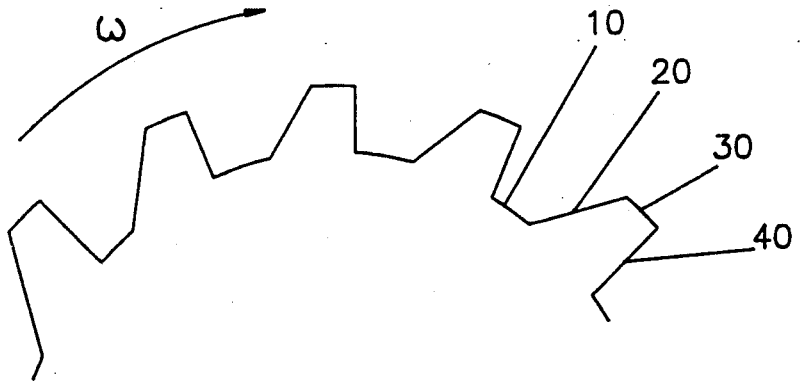

FIGS. 4 and 4a show a unique pumping rotor where the clearance 90 with the screen cylinder 80 is constant. As shown, the path 60 formed by the upper plane of the contour surface is now circular versus the elliptical path 70 formed by the first plane. The constant clearance is obtained by changing the size or depth of the side plane 40 for each contour protrusion. The pumping action of the rotor is due to the decrease in void volume in the screening zone 55 between the rotor base 70 and the internal diameter of the screen 80.

The advantage of the rotor shown in FIG. 4 is that a constant clearance is maintained between the upper plane 30 and the internal diameter of the screen 80 thus ensuring that a maximum circumferential stock velocity is achieved in the screening zone to produce maximum intensity and magnitude pulses induced by the flow over the contoured surface of the screen cylinder.

The depth of the upper plane 30 varies between ⅛" and 2", preferably ⅝". The depth of the perpendicular side plane 40 varies between ⅛" and 2", preferably ½". The rate of revolution of the rotor varies between 400 RPM and 2200 RPM. The profile pitch of the rotor varies between ½" and 6".

Figure 5A:
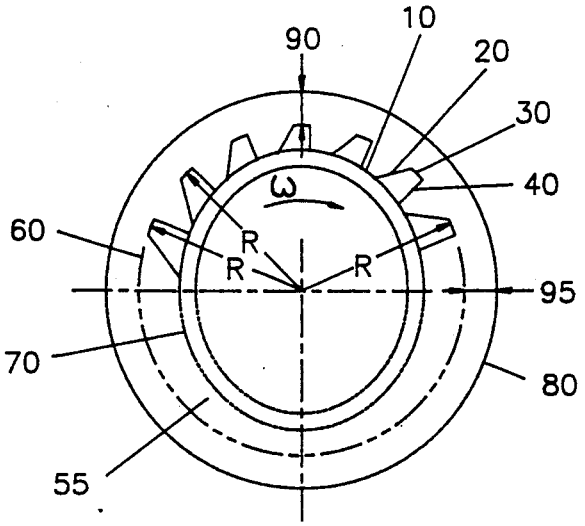
Figure 5B:
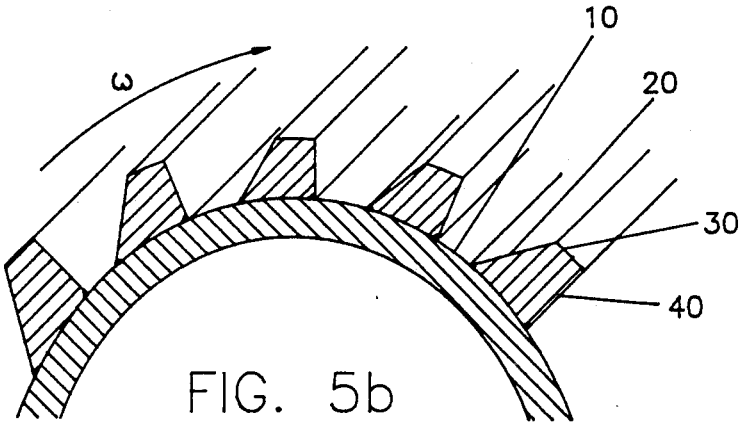
Figure 5C:
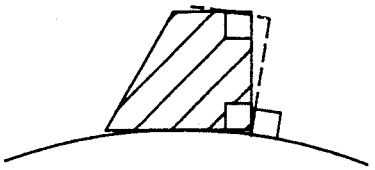

FIGS. 5a and 5b illustrate a rotor according to the invention with bars. The bars may be made of varying depth so as to keep the clearance with the screen cylinder constant. FIG. 5c illustrates a typical shape of the bars. Cam shaped rotors with contour surfaces are ideal to use with all screen cylinders which have contoured surfaces, on the inlet side of the screen cylinder. The reason is that all these designed bar screen cylinders depend upon maintaining high circumferential stock velocities at the surface of the screen cylinder to produce the self-induce of pulses which help keep the apertures within the screen from plugging and which also fluidize the fiber suspension making it easier to flow through the apertures.

In order to achieve a screening apparatus with low energy requirements and higher screening efficiency, contour shape protrusions may be of different designs and the orientations on the rotor surface may be different to produce different results for various applications.

The contour shape protrusions are arranged along the axial length of the non-cylindrical rotor. The protrusions are arranged to produce high intensity pulses over the entire screen cylindrical surface without the need to make the protrusions the full length of the rotor. This is preferably, but is not essential, accomplished by spacing the protrusions in rows such that a spacing is provided between adjacent protrusions in one row and the two protrusions of the next row are offset and face the spacing in the preceding row. By making the length of the protrusions shorter, the overall energy requirement of the screening apparatus is reduced, due to lower pumping forces. Further, screening is improved inducing more turbulence in the screening area between the rotor and the screen cylinder. Still another advantage is that the short protrusions reduce the swirling motion of the fluid within the screening zone.

It should be noted that pulses produced from the contour shape protrusions are different in magnitude, intensity, and frequency depending upon their specific shape, size, rotor speed and orientation.

Figure 6:
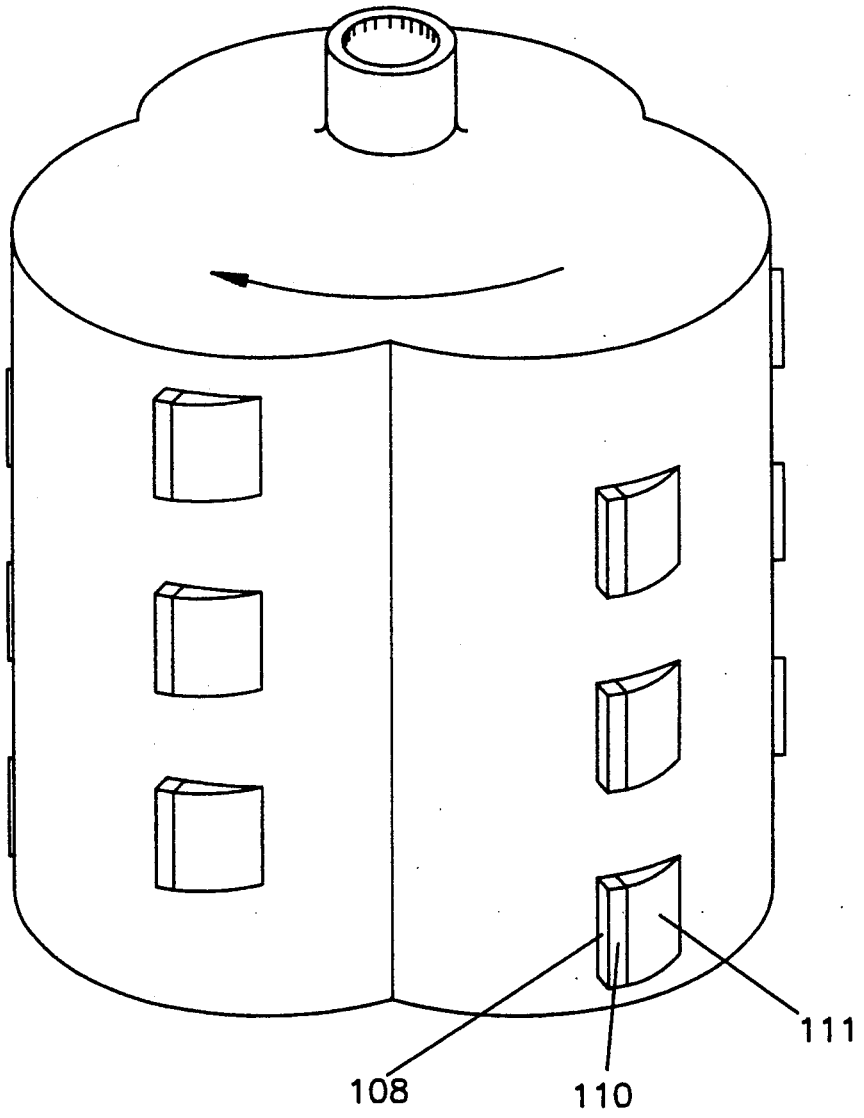
FIG. 6 illustrates one embodiment of the rotor with a plurality of protrusions in the axial length of the rotor, according to which the leading surface 108 of the protrusions is perpendicular to the rotor surface.

In FIG. 6 side plane 108 is the leading surface of the protrusions followed by the upper plane 110 forming a right angle with the side plane. Trailing the upper plane 110 is the inclined plane 111 which is at an angle between 5° and 60° in reference to the upper plane.

The lobes or cam shape surface on the non-cylindrical rotor gives the pumping action forcing the stock to flow through the apertures, holes or slots within the screen cylinder. The positive pulses produced from the lobed rotor surface are high in magnitude, but lower in frequency normally in the range of 2 to 3 pulses per revolution versus the protrusions on the rotor surface which produce between 4 to 16 pulses per revolution.

In the embodiment of FIG. 6, a sharp intensity positive pulse is produced from the leading side plane 108 which is at an essentially right angle to the rotor surface followed by a negative pulse which is less intense but higher in magnitude due to the inclined surface 111. The leading side plane 108 produces a high intensity pulse because the rate of displacement of the fluid within its path is very high due to the right angle surface but its magnitude is lower due to the fact that the amount of fluid displaced is lower than what is displaced from the cam shape lobes on the non-cylindrical lobes. The negative pulse from the inclined plane 111 helps backflushing the apertures within the screen keeping them from plugging. The greater the angle of the inclined plane, the greater is the negative pulse produced.

Figure 7:
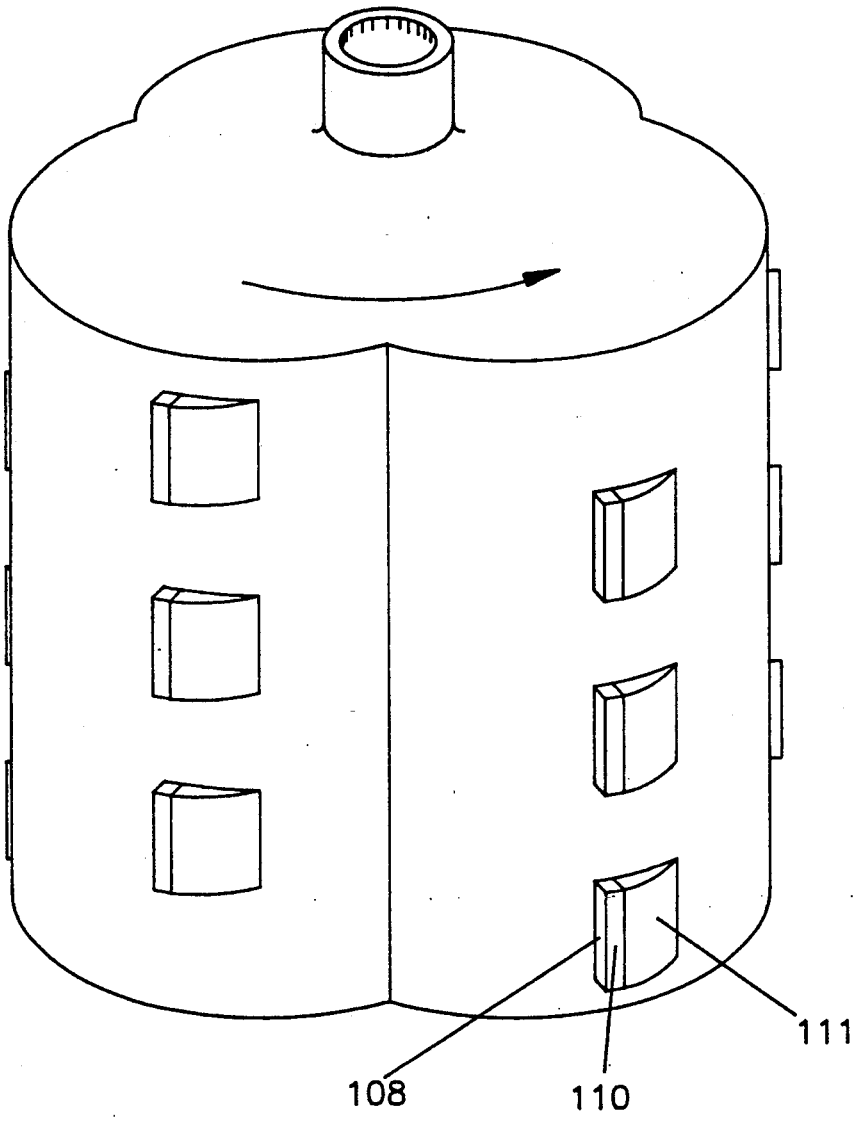
FIG. 7 illustrates another embodiment of the rotor according to the present invention with protrusions according to which the inclined surface is the leading surface.

In the embodiment of FIG. 7, the inclined plane 111 is the leading surface of the protrusions followed by the upper plane 110 and side plane 108. A rotor with protrusions of this configuration is advantageously used in a screening apparatus when less intense positive pulses are desired to reduce the tendency to force long fibers and reject through the apertures within the screen, for example, in a pulp mill screening when high concentration of the rejects and long fibers is desired for reject refining.

Figure 8:
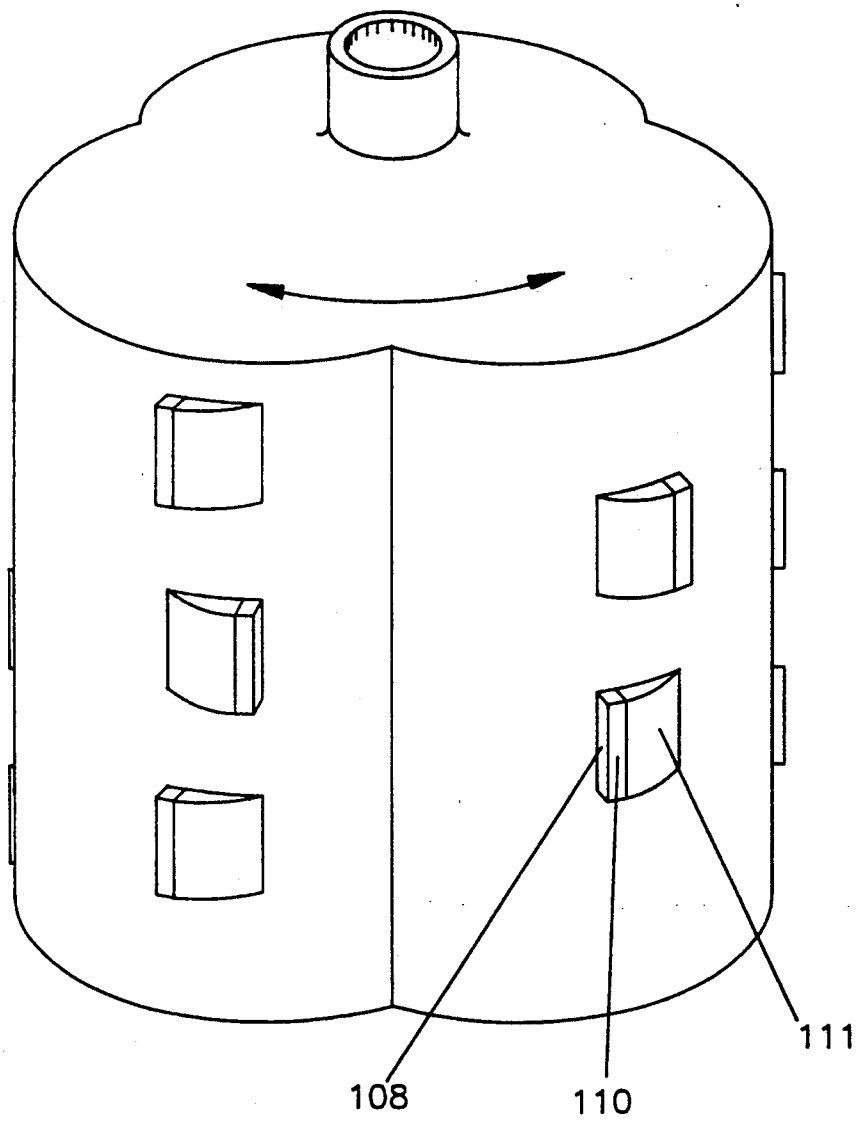
FIG. 8 illustrates another embodiment of the rotor according to which some of the surfaces of the protrusions are perpendicular to the rotor surface and some of the surfaces inclined with respect to the rotor surface are the leading surfaces.

FIG. 8 illustrates an embodiment in which the leading surfaces of the protrusions is either the inclined plane 111 or the side plane 108. This rotor configuration produces a combination of high and low intensity positive and negative pulses.

Figure 9:
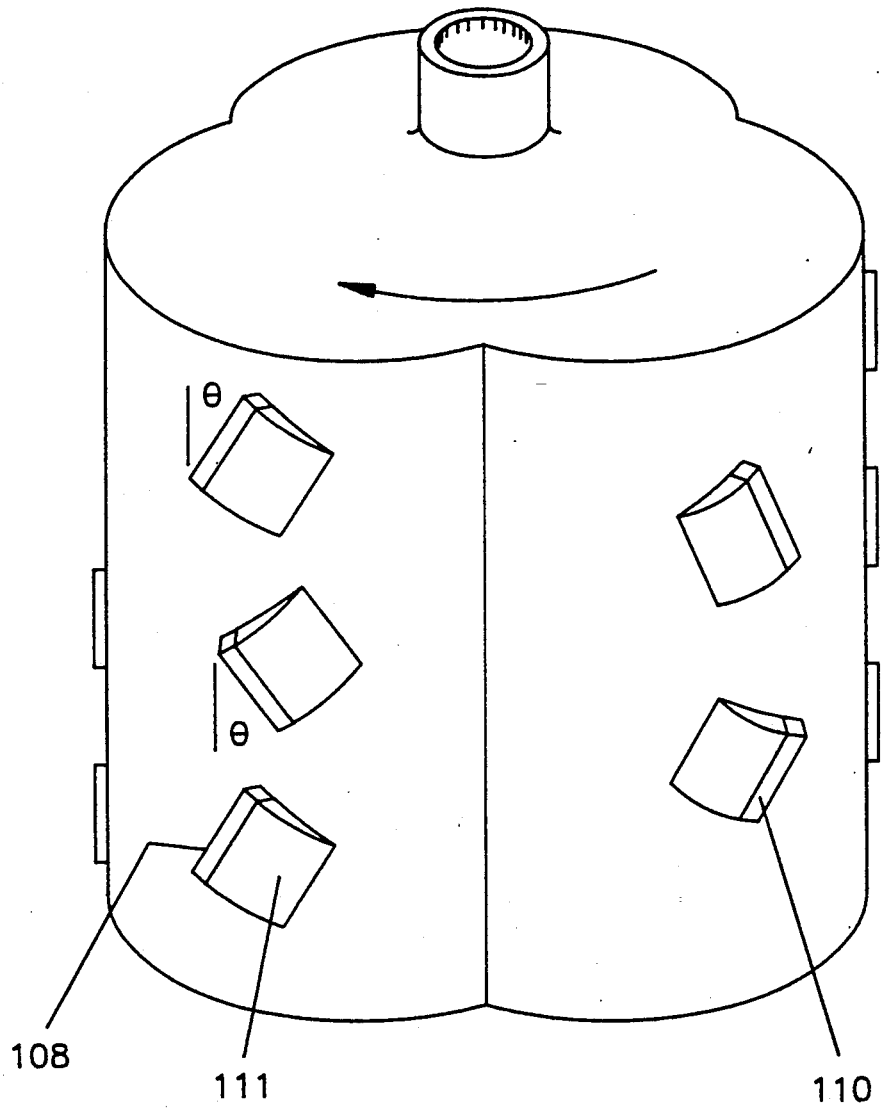
FIG. 9 illustrates another embodiment of the rotor of the invention according to which the protrusions are inclined with respect to the axis of the rotor and the leading surface is perpendicular or inclined with respect to the rotor surface. The inclination may be varied.

The embodiment of FIG. 9 is similar to the embodiment of FIG. 8 with the leading surfaces alternating between at least one of the inclined planes or surfaces and at least one of the side planes with the difference that the protrusions are oriented at an angle in respect to the axis rotation of the rotor. The angle of orientation is normally between 0° and 60° with 45° being a typical orientation either positive or negative angle as shown in FIG. 9. This rotor configuration is advantageously used in screening applications when more turbulence within the screening zone is desired to help fluidize the stock by making it easier to screen the stock at high consistencies with fine apertures. This increase in fluidization is obtained by rapidly changing continuously the direction of the stock flow within the screening zone. As shown in FIG. 9 these changes in flow direction are accomplished by angling the contour shape protrusions away from the axis of rotation. By angling these protrusions, some positive and some negative, axial flows are induced in both directions and the pulses produced by the protrusions are changed by having some leading surfaces the side plane 108 and others having the inclined plane 111 as the leading surfaces. This combination produces increased turbulence which gives the desired fluidization for improved screening.

Figure 10A:
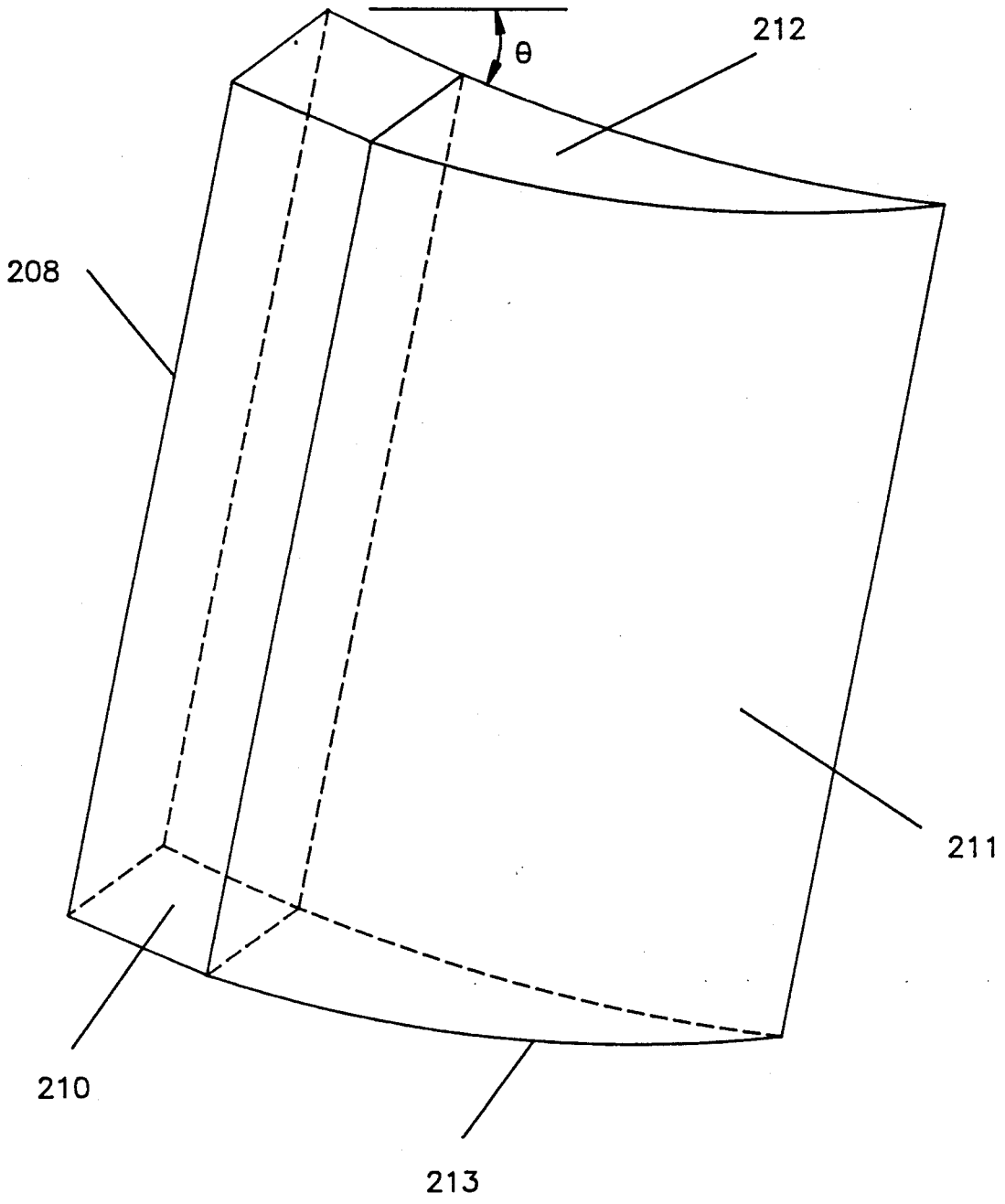

The protrusions shown in FIGS. 6 through 9 may have slightly different shapes as shown in FIGS. 10A, B and C. Different shapes are advantageously used for various screening applications because the desired end results are not always the same as previously explained.

FIG. 10A shows a typical contour shape protrusions with a side plane 208, upper plane 210, inclined plane 211, and two edge surfaces 212 and 213 respectively. The side plane 208 is always at right angles to the rotor surface and intersects the upper plane 210 forming another right angle. Intersecting the upper plane is the inclined plane 211 at an angle between 5° and 60° with respect to the upper plane. The two edge surfaces 212 and 213 start from the rotor surface and intersect the inclined plane 211 forming a right angle. The edge surfaces may be parallel to the direction of rotation or angled at some angle $\phi$ as shown in FIG. 10A. This angle $\phi$ may be either a positive or negative with a typical value between 0° and 60°.

Figure 10B:
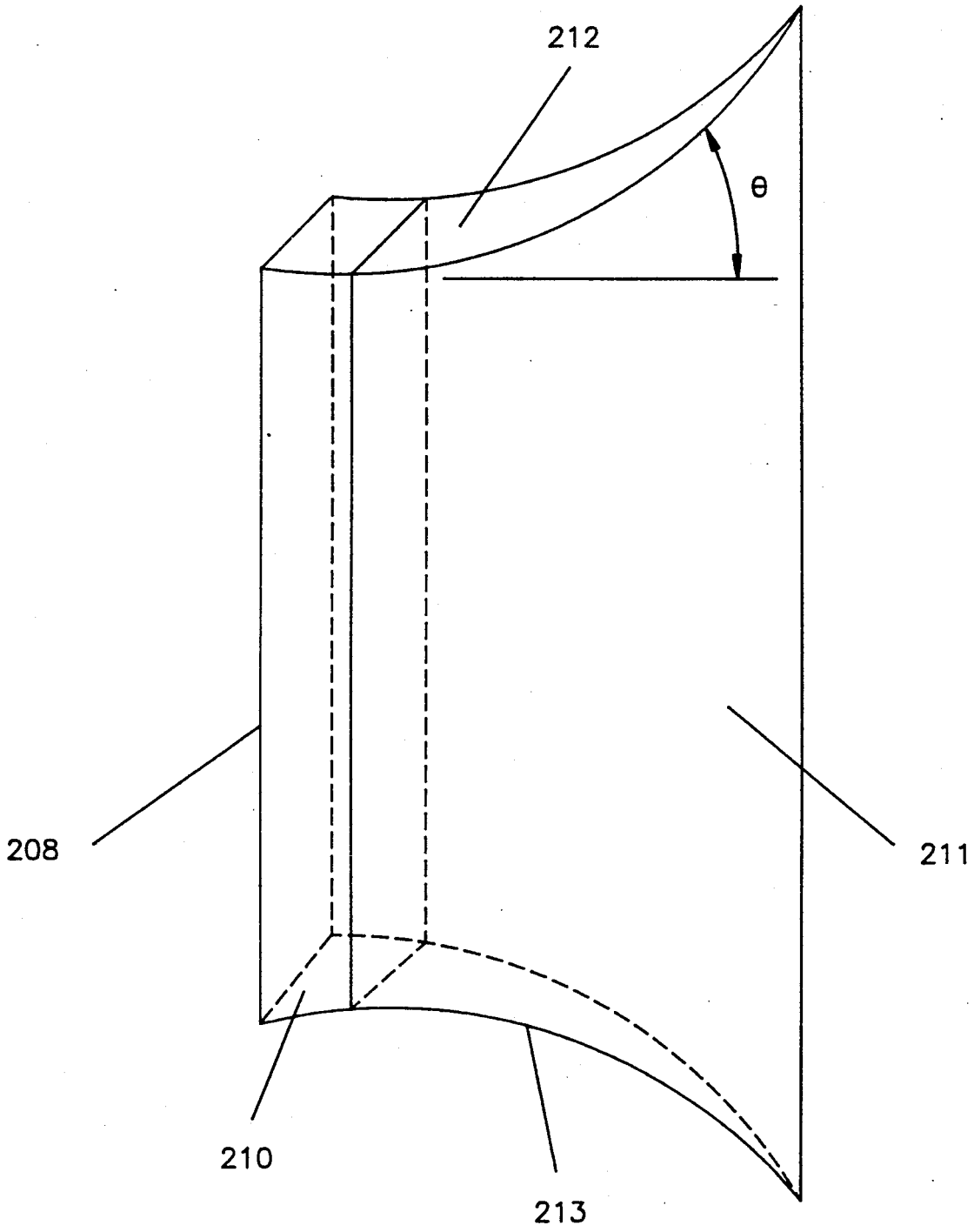

FIG. 10B is similar to FIG. 10A with the exception that the edge surfaces 212 and 213 are not parallel to each other. As shown in the figure the edge surfaces diverge the flow around the protrusions similar to a snowplow, again increasing the axial flows and turbulence within the screening zone. The diverging angle $\phi$ may be of any angle between 0° and 60°. The edges may be a plane surface or at some radius or curved surface.

Figure 10C:
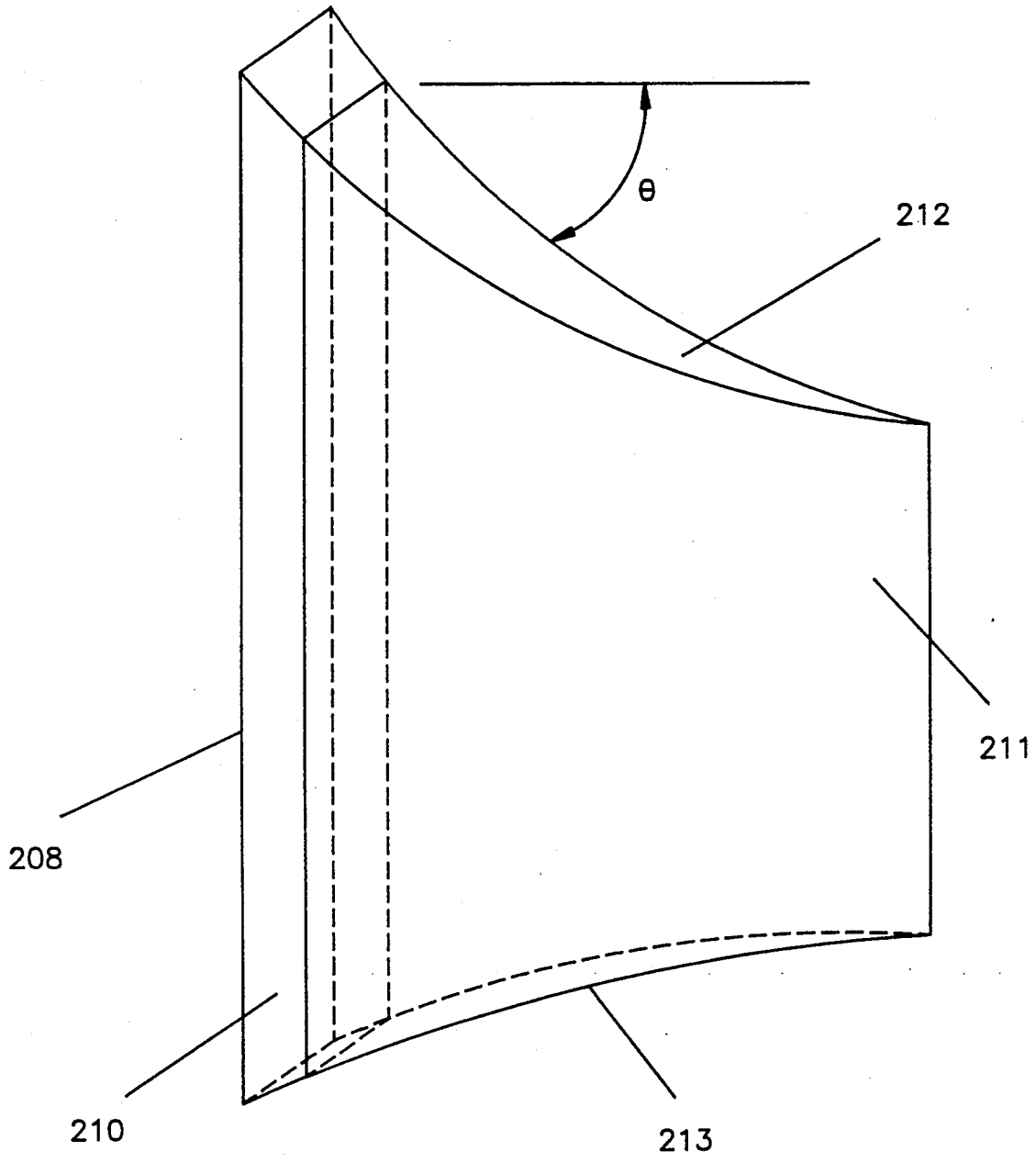

The protrusions shown in FIG. 10C are similar to the other protrusions except that the edge surfaces 212 and 213 converge instead of diverging like the protrusion shown in FIG. 10B. The edge surfaces converge at an angle with a value between 0° and 60°. Again similarly to FIG. 10B, the edge surfaces may be a plane or curved surface. This shape of protrusions also induces the flow in the axial direction. Obviously another shape of protrusion could have one edge diverging while the other edge converging.

FIG. 11 is a diagrammatic representation of the developed surface of another embodiment of the rotor according to the present invention with a plurality of protrusions in the jacket 400 and with a discontinuous contour surface. The protrusions are preferably arranged in rows. Row 401 contains protrusions 401*a*, 401*b* etc., the remaining protrusions not shown. The next row 402 contains protrusions 402*a*, 402*b*, etc. and the other rows 403, 404, 405 and 406 follow in the same fashion. Reference numeral 407 indicates the direction of rotation of the rotor. Each protrusion has a leading surface 408, a trailing surface 409, two side surfaces 411 and 412 and preferably also a top surface 410. The leading surfaces of the adjacent protrusions 401*b* and 402*a* are designated with the same reference numeral 408 and the same designation is used for one of the sides surfaces 411 of the protrusion 401*b* which is second in the row 401.

The protrusions may be arranged at random. One preferred arrangement of the protrusions is apparent from the diagrammatic representation. The rows 401–406 may extend parallel with the axis of rotation as in FIG. 11, or at an angle to such axis, along a steep helical curve, in the direction from one axial end of the rotor to the other. A spacing is provided between adjacent protrusions in each row. Specifically, the two adjacent protrusions 401*a*, 401*b* of the row 401 are spaced from each other to define therebetween a passage 413, in the direction of or against the arrow 407. The protrusions 402*a* and 402*b* of the next row 402 are offset with respect to protrusions 401*a*, 401*b* so that their leading faces 408 face each one of the passages 413*a* and 413*b*. The side walls 411 and 412 of each protrusion 401*a*–406*b* are preferably so arranged that the side walls 411 and 412 of each adjacent pair of protrusions 401*a*, 401*b* define a passage 413*a* and 413*b* which is wider at one end and narrower at the other, but the side walls 411 and 412 could also be parallel. Due to the particular configuration of the protrusions, the forward or leading end of each passage 413*a*, 413*b* is alternately wider or narrower than its trailing end.

The screen cylinder has apertures at the bottom of the grooves or in the space between two bars, and the apertures may be positioned on a plurality of rows within each groove or in the space between two bars.

Figure 12:
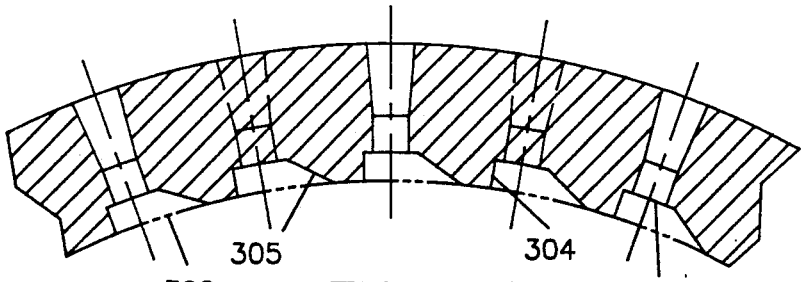
Figure 13:
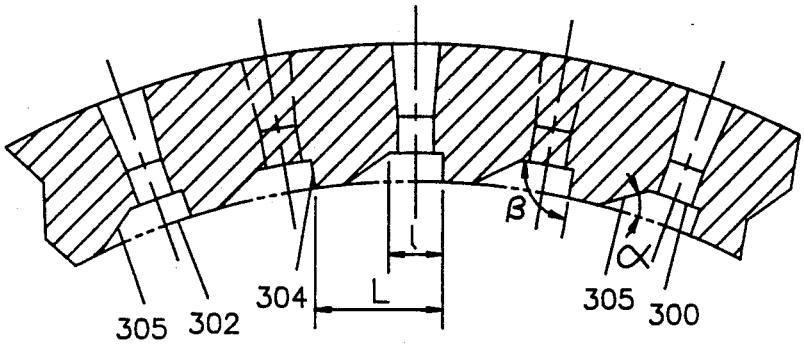

In the embodiments of FIGS. 12 and 13, the groove in the screen is formed of a bottom plane 300 which is substantially parallel with the envelope surface 302 of the screen surface, an upstream side plane 304 as seen standing from the bottom of the groove and a downstream side plane 305. In FIG. 12, the angle between the envelope surface of the screen surface and the upstream side plane 304, or in other words, between the plane tangenting the envelope surface of the screen surface close to this side plane, and this side plane is approximately 90° and the angle between the envelope surface of the screen surface and the downstream side plane 305 is 5°–60°. In FIG. 13 the angle $\alpha$ is 5°–60°, and the angle $\beta$ is 90°. The perforations of the screen plate are disposed on the bottom planes 300 of the grooves.

Figure 14:
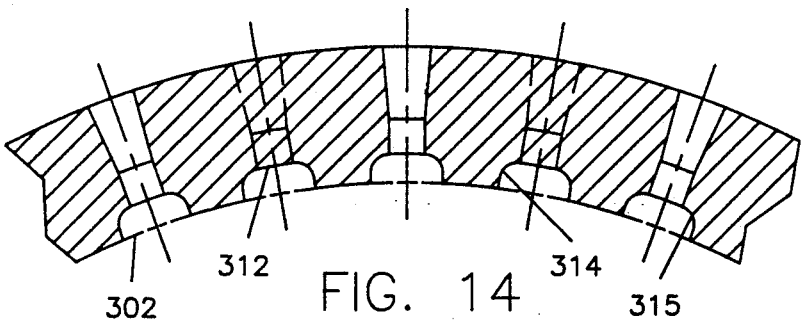

In the embodiment illustrated in FIG. 14, the grooves are U-shapes and both side planes 314 and 315 are substantially perpendicular to the envelope surface 302 of the screen surface.

Figure 15:
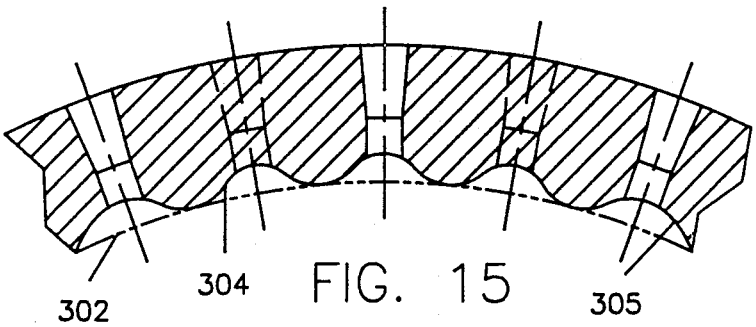

In the embodiment of FIG. 15, the screen surface is undulant, and both sides 304 and 305 of the grooves are inclined with regard to the envelope surface 302 of the screen surface.

Figure 16:
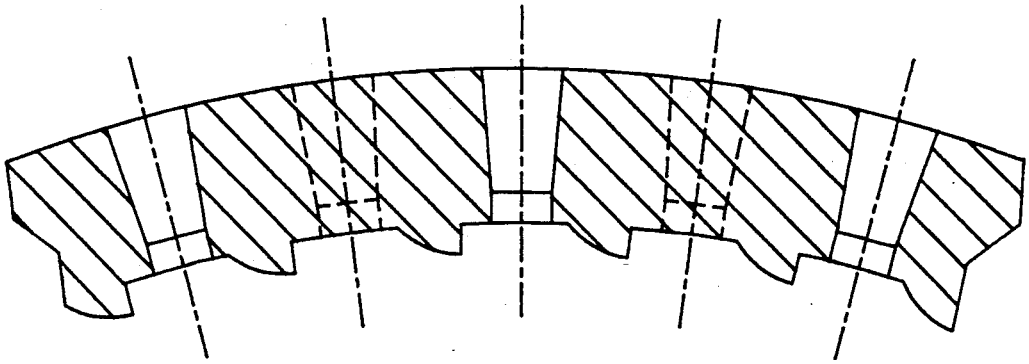
Figure 17:
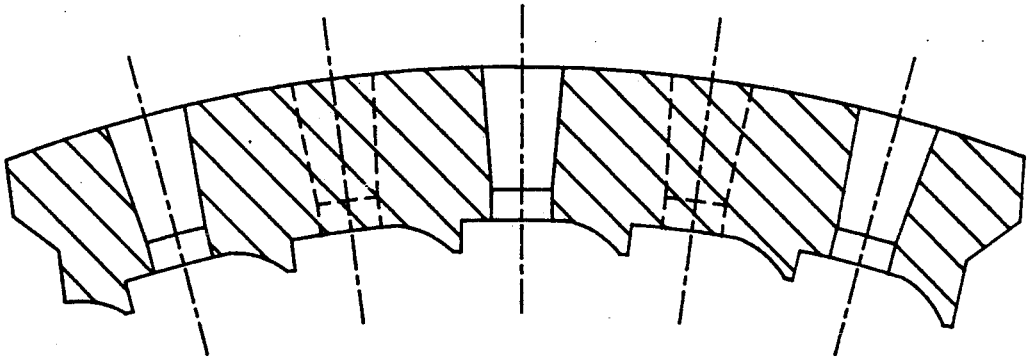
Figure 18:
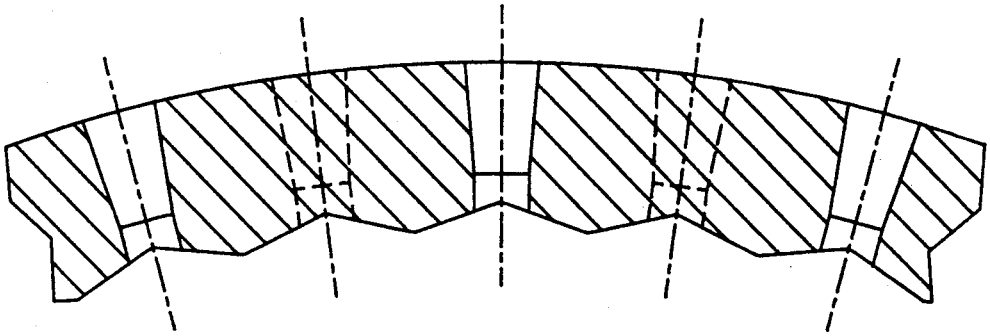

In the embodiments of FIGS. 16 and 17, the grooves have two side planes, a bottom plane and an upper plane, one side plane is perpendicular to the envelope surface of the screen cylinder, and the other side plane is curved, convex or concave with respect to the envelope surface. In the embodiment of FIG. 18, the sides of the grooves have an inverted V-shape configuration.

The apparatus is operated with the rotor disposed in the inlet side of the screen but is intended both for outflow operation or inflow operation.

The advantage of the arrangement of the protrusions as shown is that in addition to the generation of pulses at the surface of the screen, the resistance to rotation of the rotor is reduced thus reducing the power consumption. Further, the narrowing or widening shape of the passages between adjacent protrusions in each row provides turbulence in the axial direction which significantly contributes to the cleaning of the upstream surface of the screen thus improving the overall screening efficiency. Due to the shape and orientation of the protrusions on the non-cylindrical rotor surface, flow and velocity are induced in the axial direction both towards the inlet and the reject.

This invention is not limited to the particular shape of the protrusions shown and described, and it should be understood that other shapes may be used depending upon different applications.

What is claimed is:

1. In an apparatus for screening pulp which comprises a vessel, a screen cylinder having an envelope surface and a contour surface within the vessel, a rotor moving in the vicinity of the screen cylinder at a predetermined speed on an axis of rotation, said rotor having an axial length, an inlet for the unscreened pulp, a first outlet for the accept screened pulp in said vessel and a second outlet for the reject, said first and second outlets being in operative communication with said screen cylinder, said rotor having a non-cylindrical shape, the improvement which comprises said rotor having a contoured surface including a plurality of spaced protrusions disposed about the periphery of the rotor, each of said protrusions being shorter than the axial length of said rotor, each protrusion having a side plane essentially perpendicular to the rotor surface which is the leading surface, two edge surfaces, an upper plane parallel to the rotor surface and an inclined plane, said inclined plane forming an angle between 5°-60° with said rotor surface whereby a lower frequency pumping action, high frequency high intensity positive pulses are generated with additional high intensity axial shears with improved screening at a pulp concentration up to 6%.

2. In an apparatus for screening pulp which comprises a vessel, a screen cylinder having an envelope surface and a contour surface within the vessel, a rotor moving in the vicinity of the screen cylinder at a predetermined speed on an axis of rotation, said rotor having an axial length, an inlet for the unscreened pulp, a first outlet for the accept screened pulp in said vessel and a second outlet for the reject, said first and second outlets being in operative communication with said screen cylinder, said rotor having a non-cylindrical shape, the improvement which comprises said rotor having a contoured surface including a plurality of spaced protrusions disposed about the periphery of the rotor, each of said protrusions being shorter than the axial length of said rotor, each protrusion having an inclined plane or surface which is the leading surface, an upper plane or surface parallel to the rotor surface, a side plane or surface, and two edge planes or surfaces, said inclined plane or surface forming an angle between 5°-60° with said rotor surface whereby a lower frequency pumping action, high frequency high intensity positive pulses are generated with additional high intensity axial shears with improved screening at a pulp concentration up to 6%.

3. In an apparatus for screening pulp which comprises a vessel, a screen cylinder having an envelope surface and a contour surface within the vessel, a rotor moving in the vicinity of the screen cylinder at a predetermined speed on an axis of rotation, said rotor having an axial length, an inlet for the unscreened pulp, a first outlet for the accept screened pulp in said vessel and a second outlet for the reject, said first and second outlets being in operative communication with said screen cylinder, said rotor having a non-cylindrical shape the improvement which comprises said rotor having a contoured surface including a plurality of spaced protrusions disposed about the periphery of the rotor, each of said protrusions being shorter than the axial length of said rotor, each protrusion having a first plane or surface essentially parallel to the envelope surface, an inclined plane or surface forming an angle between 5°-60° with said rotor surface, a plane or surface essentially perpendicular to the rotor surface, an upper plane or surface essentially parallel to the rotor surface, at least one protrusion having the inclined plane or surface as a leading surface and at least one protrusion having the substantially perpendicular plane or surface as a leading surface, whereby a lower frequency pumping action, high frequency high intensity positive pulses are generated with additional high intensity axial shears with improved screening at a pulp concentration up to 6%.

4. In an apparatus for screening pulp which comprises a vessel, a screen cylinder having an envelope surface and a contour surface within the vessel, a rotor moving in the vicinity of the screen cylinder at a predetermined speed on an axis of rotation, said rotor having an axial length, an inlet for the unscreened pulp, a first outlet for the accept screened pulp in said vessel and a second outlet for the reject, said first and second outlets being in operative communication with said screen cylinder, said rotor having a non-cylindrical shape, the improvement which comprises said rotor having a discontinuous contoured surface including a plurality of spaced protrusions disposed about the periphery of the rotor, each of said protrusions being shorter than the axial length of said rotor, each protrusion having a first rotor surface essentially parallel to the envelope surface, a leading surface perpendicular to said rotor surface, an upper plane parallel to the rotor surface and an inclined plane, said inclined plane forming an angle between 5-60° with said rotor surface whereby a lower frequency pumping action, high frequency high intensity positive pulses are generated with additional high intensity axial shears with improved screening at a pulp concentration up to 6%.

5. The apparatus according to claim 1, 2 or 3 wherein said leading surfaces of the protrusions are spaced from each other in a direction to the axis of rotation of the rotor.

6. The apparatus according to claim 1, 2 or 3 wherein said leading surfaces of the protrusions are spaced from each other in a direction parallel to the axis of rotation of the rotor.

7. The apparatus according to claim 1, 2 or 3 wherein said leading surfaces of the protrusions are spaced from each other in a direction at an angle to the axis of rotation of the rotor.

8. The apparatus according to claim 1, 2 or 3 wherein the protrusions are arranged in equidistantly spaced axial rows generally parallel to the direction of the axis of rotation, each pair of adjacent protrusions of a row being spaced from each other to define therebetween a passage.

9. The apparatus according to claim 4 wherein the protrusions are arranged in equidistantly spaced axial rows generally parallel to the direction of the axis of rotation, each pair of adjacent protrusions of a row being spaced from each other to define therebetween a passage.

10. The apparatus according to claim 4 wherein the protrusions are arranged in axial rows, one row being the leading row and the other being the trailing row, the leading surface of the protrusions of the trailing row faces the respective passage of the adjacent leading row of the protrusions.

11. The apparatus according to claim 1, 2 or 3 wherein clearance is formed between said rotor and said screen cylinder and said clearance varies between a maximum of 1½" and a minimum value of ⅛".

12. The apparatus according to claim 1, 2 or 3 wherein said rotor has an elliptical shape.

13. The apparatus according to claim 1, 2 or 3 wherein said rotor is trilobe.

14. The apparatus according to claim 1, 2 or 3 wherein said screen cylinder has an inlet side and an outlet side, said inlet side having a contoured surface produced with grooves or bars, or both grooves and bars.

15. The apparatus according to claim 1, 2 or 3 wherein said rotor is located on the inlet side of the screen cylinder.

16. The apparatus according to claim 1, 2 or 3 wherein said envelope surface of said screen cylinder has grooves with apertures, the apertures are at the bottom of the grooves, the bottom plane of the grooves is essentially parallel to the envelope surface, the grooves have two side planes, one side plane of the grooves is substantially perpendicular to the envelope surface of the screen surface and the other side plane is inclined with regard to said envelope surface.

17. The apparatus according to claim 1, 2, or 3 wherein said inlet is recessed in the screen surface and said screen cylinder has grooves in the side of the inlet recessed in the screen surface, and said screen cylinder has grooves in the side of the inlet recessed in the screen surface, the grooves being formed of an upstream side plane, as seen standing from the bottom of the grooves, a downstream side plane and a bottom plane, said bottom plane being substantially parallel to the envelope surface of the screen cylinder, the grooves having apertures in the bottom plane, the upstream side plane of the grooves being substantially perpendicular to said envelope surface and the downstream side place of the grooves forming a 60°-5° angle against said envelope surface.

18. The apparatus according to claim 1, 2 or 3 wherein said contoured surface of said screen cylinder is formed by grooves, the downstream side plane and the upstream side plane of the grooves are connected to each other.

19. The apparatus according to claim 1, 2 or 3 wherein said contoured surface of said screen cylinder is formed by grooves, the downstream side plane of the grooves is substantially perpendicular to the envelope surface of the screen surface and the upstream side plane is inclined.

20. The apparatus according to claim 1, 2 or 3 wherein the contoured surface of the screen cylinder consists of grooves and both side planes of the grooves are substantially perpendicular to the envelope surface of the screen.

21. The apparatus according to claim 1, 2 or 3 wherein the screen cylinder has grooves having apertures, the apertures are at the bottom of the grooves, the bottom plane of the grooves is parallel to the envelope surface, the grooves have two side planes and an upper plane, one side plane of the grooves is substantially perpendicular to the envelope surface of the screen cylinder and the other side plane is curved with regard to said envelope surface.

22. The apparatus according to claim 1, 2 or 3 wherein the screen cylinder has grooves having apertures, the apertures are at the bottom of the grooves, the bottom plane of the grooves is parallel to the envelope surface, the grooves have two side planes and an upper plane, one side plane of the grooves is substantially perpendicular to the envelope surface of the screen cylinder wherein said side plane is convex or concave with respect to said envelope surface of the screen cylinder.

23. The apparatus according to claim 1, 2 or 3 wherein said envelope surface of the screen cylinder is undulant, the screen cylinder has grooves and both sides of the grooves are inclined with respect to the envelope surface.

24. The apparatus according to claim 1, 2 or 3 wherein said contoured surface of the screen cylinder is formed by grooves and said grooves have an inverted V configuration.

25. The apparatus according to claim 1, 2 or 3 wherein said rotor has an inner surface, said inner surface is contoured, and the screen cylinder has an outer contoured surface, and said inner surface of the rotor faces said outer contoured surface of the screen cylinder.

26. The apparatus according to claim 1, 2 or 3 wherein the screen cylinder has a contoured surface and said contoured surface of the screen is on the inside of the screen cylinder.

27. The apparatus according to claim 1, 2 or 3 wherein said contoured surface of the screen cylinder is formed by grooves, the grooves have an upstream side plane and a downstream side plane, both said upstream side plane and said downstream side plane are inclined thereto and are connected to each other by means of a plane substantially parallel to said envelope surface.

28. The apparatus according to claim 1, 2 or 3 wherein said contoured surface of the screen cylinder is formed by grooves and a plurality of rows of apertures is provided at the bottom of each groove.

29. The apparatus according to claim 1, 2 or 3 wherein said screen cylinder has a contoured surface on the inlet side produced with bars.

* * * * *